US011352754B2

(12) United States Patent
Parker, III

(10) Patent No.: US 11,352,754 B2
(45) Date of Patent: Jun. 7, 2022

(54) MAILBOX SHIELD

(71) Applicant: Harold Emery Parker, III, Irving, NY (US)

(72) Inventor: Harold Emery Parker, III, Irving, NY (US)

( * ) Notice: Subject to any disclaimer, the term of this patent is extended or adjusted under 35 U.S.C. 154(b) by 162 days.

(21) Appl. No.: 16/778,761

(22) Filed: Jan. 31, 2020

(65) Prior Publication Data

US 2021/0238816 A1 Aug. 5, 2021

(51) Int. Cl.
*E01F 7/02* (2006.01)
*A47G 29/12* (2006.01)

(52) U.S. Cl.
CPC ..... *E01F 7/02* (2013.01); *A47G 29/1209* (2013.01); *A47G 29/1216* (2013.01)

(58) Field of Classification Search
CPC ... A47G 29/1216; A47G 29/1209; E01F 7/02; E01F 7/025
USPC ..... 232/39; 256/12.5
See application file for complete search history.

(56) References Cited

U.S. PATENT DOCUMENTS 3,966,172 A * 6/1976 Garrett ..... E01F 7/02 256/12.5
6,481,926 B2 * 11/2002 Benedict ..... E02B 3/04 256/12.5
6,558,075 B2 * 5/2003 Benedict ..... E02B 3/04 256/12.5
6,962,460 B1 * 11/2005 Pratt ..... G09F 7/00 248/636
7,080,773 B1 * 7/2006 Tepley ..... A47G 29/1216 232/17
D580,625 S * 11/2008 Ballok ..... D20/41
7,611,043 B2 * 11/2009 Black ..... A47G 29/1216 232/38
8,794,505 B1 * 8/2014 Richardson ..... A47G 29/1216 232/39
8,925,225 B2 * 1/2015 Fiore ..... A47G 29/1216 40/606.12
9,549,632 B2 * 1/2017 Pickens ..... A47G 29/1216
9,980,593 B2 * 5/2018 Pajonas ..... A47G 29/1209
10,022,007 B1 * 7/2018 Lucero ..... G09F 7/18
10,448,772 B1 * 10/2019 Fiore ..... E01F 7/00
D903,225 S * 11/2020 Hillary ..... D99/43
2006/0124913 A1 * 6/2006 Keedwell ..... E02B 3/102 256/12.5
2006/0186188 A1 * 8/2006 Belanger ..... A47G 29/1216 232/38
2008/0314967 A1 * 12/2008 Black ..... A47G 29/1216 232/39
2010/0243977 A1 * 9/2010 Middlebrook, Jr. ..... E01F 7/00 256/12.5
2013/0232834 A1 * 9/2013 Fiore ..... A47G 29/122 40/606.03
2016/0073812 A1 * 3/2016 Pickens ..... A47G 29/1216 232/38
2021/0172134 A1 * 6/2021 Battjes ..... A47G 29/122

* cited by examiner

*Primary Examiner* — William L Miller
(74) *Attorney, Agent, or Firm* — Bruce A. Lev

(57) ABSTRACT

A mailbox shield that includes first and second panels connected to one another forming an angle therebetween. The first and second panels are held in place by a plurality of wires therebetween and a post that is adjustable in height and is adapted to be inserted into a ground surface adjacent to a mailbox and is designed to deflect snow and ice being thrown or piled upon the mailbox by a passing snow plow.

20 Claims, 2 Drawing Sheets

MAILBOX SHIELD

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to devices that protect and/or shield mailboxes that are susceptible to snow and ice being thrown or piled thereon.

2. Description of the Related Art

Prior art mailboxes have been formed in various shapes and sizes and with surfaces that may or may not provide protection from snow and ice being thrown or piled thereon. However, no known prior art disclose shielding a mailbox using s device that is spaced from the mailbox and designed to deflect snow and ice being thrown or piled thereon by a passing snow plow.

Accordingly, the present invention overcomes the disadvantages associated with the prior art, by providing a mailbox shield that is adapted to be placed adjacent to a mailbox and designed to deflect snow and ice being thrown or piled thereon by a passing snow plow away from the mailbox.

BRIEF SUMMARY OF THE INVENTION

In view of the foregoing disadvantages, the present invention provides a mailbox shield that is adapted to be placed adjacent to a mailbox and is designed to deflect snow and ice being thrown or piled thereon by a passing snow plow away from the mailbox.

It is an object of the present invention to provide a mailbox shield that includes first and second panels that are connected to one another forming an angle therebetween. The first and second panels are held in place by a plurality of wires therebetween and a post that is adjustable in height and is adapted to be inserted into a ground surface adjacent the mailbox.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
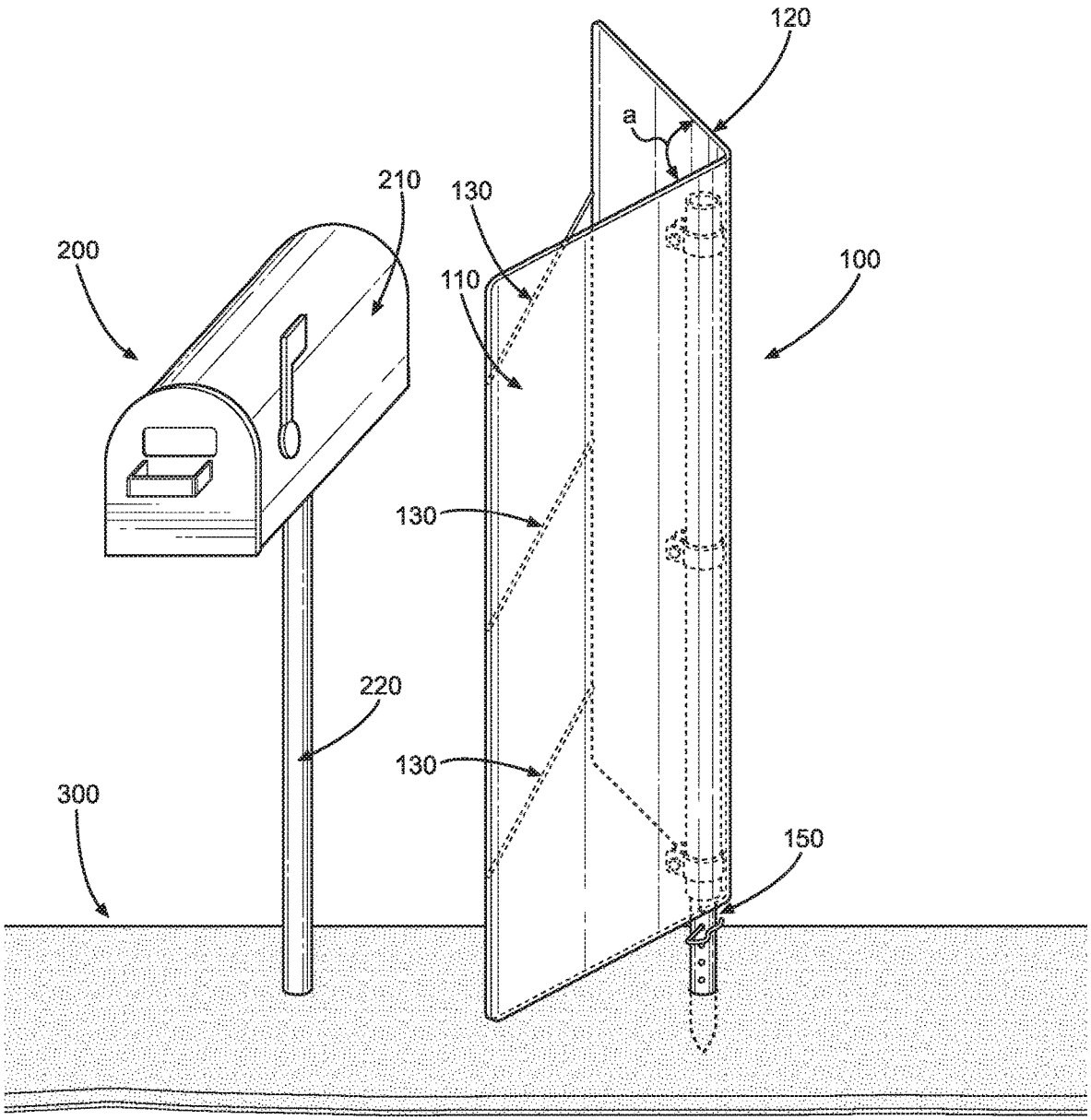
FIG. 1 shows a perspective view the mailbox shield in use adjacent a mailbox according to the preferred embodiment of the present invention.
Figure 2:
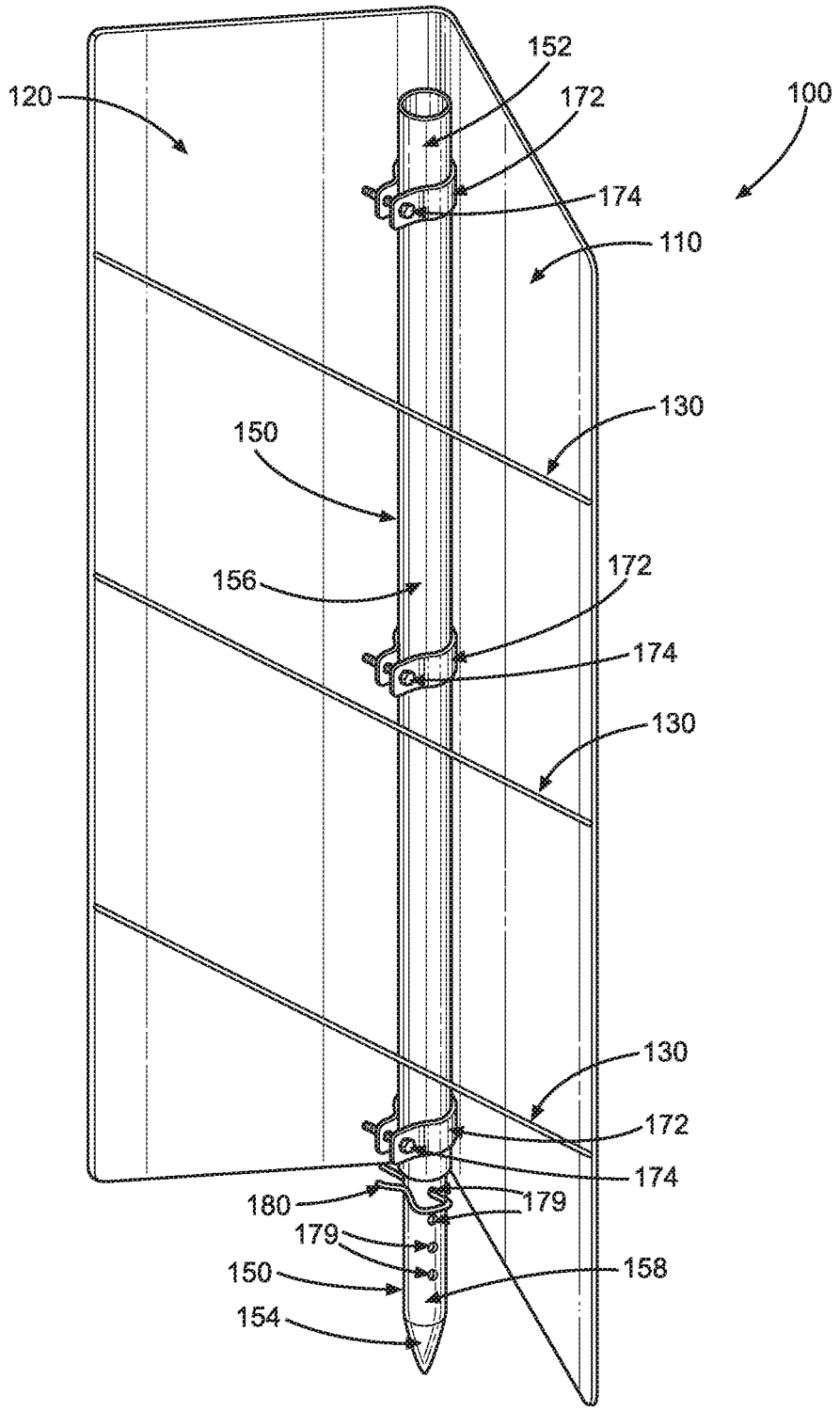
FIG. 2 shows a close-up perspective view of the mailbox shield according to the preferred embodiment of the present invention of FIG. 1.

Referring now to FIGS. 1 & 2, the present invention discloses a mailbox shield 100 adapted to protect a mailbox 200 that typically includes a box 210 and a post 220 adapted to hold the box in place above a ground surface. The mailbox shield 100 comprises a first panel 110 and a second panel 120 connected to one another at respective edges thereof forming an angle (a) therebetween; at least one wire 130 connected between the first and second panels to help keep the panels in the proper position; and an elongated post 150 including a proximal end 152 and a distal end 154; wherein the first and second panels are connected to the elongated post in proximity to the proximal end; and wherein the mailbox shield 100 is located adjacent to the mailbox 200, such that the first and second panels are located adjacent to the box of the mailbox and is adapted to deflect snow and ice away from the box. The distal end 154 of the elongated post 150 may be tapered and thereby adapted to be inserted into a ground surface 300. The elongated post may be formed from two telescoping tubes (156 & 158) that are linearly adjustable to one another, i.e., via holes 179 and cotter pin 180, to thereby adjust the height of the first and second panels from a ground surface when in use. The angle (a) formed by the first and second panels can be between 60 and 120 degrees, but in most cases the angle formed by the first and second panels is closer to 90 degrees. The first and second panels may be formed from stainless steel. The wires 130 may be connected between the first and second panels in proximity to respective edges opposite the respective edges that are connected together. In a preferred embodiment there are three spaced wires 130 connected between the first and second panels. The preferred dimensions of each wire may be 10 Gage, 13.5 inches in length, and have a ⅛ inch bend at respective ends thereof. The first and second panels can be connected to the elongated post via a clamp 170 connected between the first and second panels, and a stove bolt 174 adapted to tighten and loosen the clamp around the elongated post. The preferred dimensions of the mailbox shield 100 includes the elongated post 150 being extendable to at least 50 inches in length, the first panel 110 and a second panel 120 being between 40 inches and 50 inches in height, and the distance between respective outer edges of the first and second panels is 13.5 inches. As such, the mailbox shield 100 is designed to protect a common residential standing mailbox installed on a ground surface at a height of between 41 and 45 inches from a road surface, and having approximate dimensions of 19-24 inches in length by 6-11 inches in width by 8-13 inches in height.

The instant mailbox shield 100 as shaped and described is adapted to be placed adjacent to the mailbox 200, as shown in FIG. 1, and is designed to deflect snow and ice being thrown or piled thereon by a passing snow plow away from the mailbox.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A mailbox shield comprising:
- a first panel;
- a second panel;
- wherein said first and second panels are connected to one another at respective edges thereof forming an angle therebetween;
- at least one wire;
  - wherein said at least one wire is connected between said first and second panels;
  - wherein said at least one wire is adapted to keep said first and second panels in the proper position; and
- an elongated post including:
  - a proximal end; and
  - a distal end;
- wherein said first and second panels are connected to said elongated post in proximity to said proximal end thereof.

2. The mailbox shield of claim 1, wherein said distal end of said elongated post is tapered and adapted to be inserted into a ground surface.

3. The mailbox shield of claim 2, wherein said elongated post is formed from two telescoping tubes that are linearly adjustable to one another to thereby adjust the height of said first and second panels from a ground surface when in use.

4. The mailbox shield of claim 1, wherein said angle formed by said first and second panels is between 60 and 120 degrees.

5. The mailbox shield of claim 1, wherein said angle formed by said first and second panels is substantially 90 degrees.

6. The mailbox shield of claim 1, wherein said first and second panels are formed from stainless steel.

7. The mailbox shield of claim 1, wherein said at least one wire is connected between said first and second panels in proximity to respective edges opposite said respective edges that are connected together.

8. The mailbox shield of claim 1, wherein there are at least two spaced wires connected between said first and second panels.

9. The mailbox shield of claim 8, wherein said at least two wires are connected between said first and second panels in proximity to respective edges opposite said respective edges that are connected together.

10. The mailbox shield of claim 1, wherein said first and second panels are connected to said elongated post via a clamp connected between said first and second panels, and a stove bolt adapted to tighten and loosen said clamp around said elongated post.

11. A combination of a mailbox and a mailbox shield, said combination comprising:
- a mailbox including:
  - a box:
    - wherein said box is adapted to releasably hold mail therein; and
  - a post including:
    - a proximal end; and
    - a distal end;
    - wherein said distal end is adapted to be inserted into a ground surface and hold said box above said ground surface;
  - wherein said box is attached to said proximal end of said post and is held above said ground surface; and
- a mailbox shield comprising:
  - a first panel;
  - a second panel;
  - wherein said first and second panels are connected to one another at respective edges thereof forming an angle therebetween;
  - at least one wire;
    - wherein said at least one wire is connected between said first and second panels;
    - wherein said at least one wire is adapted to keep said first and second panels in the proper position; and
  - an elongated post including:
    - a proximal end; and
    - a distal end;
  - wherein said first and second panels are connected to said elongated post in proximity to said proximal end thereof;
  - wherein said mailbox shield is located adjacent to said mailbox, such that said first and second panels are located adjacent said box of said mailbox and adapted to deflect snow and ice away from said box.

12. The combination of claim 11, wherein said distal end of said elongated post is tapered and adapted to be inserted into a ground surface.

13. The combination of claim 12, wherein said elongated post is formed from two telescoping tubes that are linearly adjustable to one another to thereby adjust the height of said first and second panels from a ground surface when in use.

14. The combination of claim 11, wherein said angle formed by said first and second panels is between 60 and 120 degrees.

15. The combination of claim 11, wherein said angle formed by said first and second panels is substantially 90 degrees.

16. The combination of claim 11, wherein said first and second panels are formed from stainless steel.

17. The combination of claim 11, wherein said at least one wire is connected between said first and second panels in proximity to respective edges opposite said respective edges that are connected together.

18. The combination of claim 11, wherein there are at least two spaced wires connected between said first and second panels.

19. The combination of claim 18, wherein said at least two wires are connected between said first and second panels in proximity to respective edges opposite said respective edges that are connected together.

20. The combination of claim 11, wherein said first and second panels are connected to said elongated post via a clamp connected between said first and second panels, and a stove bolt adapted to tighten and loosen said clamp around said elongated post.

* * * * *